US005254206A

United States Patent [19]

Wing

[11] Patent Number: 5,254,206

[45] Date of Patent: Oct. 19, 1993

[54] HAND-HELD LABELING DEVICE

[76] Inventor: Donald B. Wing, 304 Front St., Marion, Mass. 02738

[21] Appl. No.: 828,508

[22] Filed: Jan. 31, 1992

[51] Int. Cl.[5] ..... B44C 7/00

[52] U.S. Cl. ..... 156/542; 156/384; 156/523; 156/576; 156/577; 156/579; 156/581; 156/574

[58] Field of Search ..... 156/542, 576, 579, 577, 156/574, 523, 581, 384; 428/411.1

[56] References Cited

U.S. PATENT DOCUMENTS

| | | | |
|---|---|---|---|
| 3,051,353 | 8/1962 | Krueger . | |
| 3,586,587 | 6/1971 | Boyce | 156/577 |
| 3,709,760 | 1/1973 | Knoner | 156/577 |
| 3,951,726 | 4/1976 | Found | 156/579 |
| 3,955,711 | 5/1976 | Schroter et al. | 156/577 |
| 4,008,119 | 2/1977 | Hermann . | |
| 4,012,273 | 3/1977 | Inka | 156/579 |
| 4,166,757 | 9/1979 | Hamisch, Jr. | 156/577 |
| 4,238,271 | 12/1980 | Urushizaki | 156/577 |
| 4,253,395 | 3/1981 | Sato . | |
| 4,253,905 | 3/1981 | Regan | 156/577 |
| 4,369,085 | 1/1983 | Hermann . | |
| 4,382,835 | 5/1983 | Sato et al. . | |
| 4,406,727 | 9/1983 | Fujita . | |
| 4,588,469 | 5/1986 | Hunter | 156/579 |
| 4,591,407 | 5/1986 | Samuelson | 156/577 |
| 4,624,734 | 11/1986 | Voltmer et al. | 156/542 |
| 4,699,685 | 10/1987 | Sato | 156/577 |
| 4,724,034 | 2/1988 | Becker . | |
| 4,851,076 | 7/1989 | Manusch et al. | 156/577 |
| 4,853,068 | 8/1989 | Becker . | |
| 4,985,110 | 1/1991 | Becker . | |
| 4,986,874 | 1/1991 | Kawada | 156/577 |
| 5,013,390 | 5/1991 | Hermann . | |
| 5,076,883 | 12/1991 | Bosley | 156/579 |

*Primary Examiner*—Patrick J. Ryan
*Assistant Examiner*—Merrick Dixon
*Attorney, Agent, or Firm*—Donald S. Holland

[57] ABSTRACT

An apparatus for administering self-adhesive labels is disclosed. In the preferred embodiment, the invention comprises an advance lever, which activates a driving mechanism which rotates two cooperating rolling bars; a wiper bar in cooperation with a deflection bar, which forms a stripping mechanism; and a clear label path. Because of the paucity of parts, the user can view a web at all times. In addition, some parts are transparent, which enhances the user's ability to monitor labels. Because of the sharp edge of the deflection bar, the labels are separated from the base ply and projected forward, while the base ply is pulled back and away from the label. Then, due to the beveled edge of the wiper bar, the labels are applied with a wiping motion, rather than a rotating motion.

32 Claims, 2 Drawing Sheets

HAND-HELD LABELING DEVICE

BACKGROUND OF THE INVENTION

The present invention relates to label applicators, and, more particularly, to devices for applying self-adhesive labels — commonly known as "crack—and—peel" labels — to underlying surfaces such as envelopes or packages used in mass mailing or warehouse applications for boxes.

There are many labelers which are currently on the market. Most of these label applicators are used primarily for the price marking of goods in the retail trade, in particular, supermarkets and self-service shops. Because these applicators are designed for use with such small price labels, they are not structurally equipped to handle the needs of larger self-adhesive mail labels. (Standard mail labels are $3\frac{1}{2} \times 15/16$ inches.) For example, the size and weight of the mail labels would make them impractical to use in a standard, or even enlarged, price labeler. The weight of the mail labels would render the price labeler off-balance and too heavy to use. In addition, most price labelers operate with labels which are in a roll (see U.S. Pat. Nos. 4,008,119 and 4,369,085). Mail labels often do not come in a roll like price labels do. Instead, mail labels arrive in long, flat, pleated sheets. Consequently, the mail labels would have to be removed from their flat packaging and wound into a roll. This would be a time consuming extra step.

Typically, these price labelers require its user to apply the label with a rolling motion or require an application roller. For example, see U.S. Pat. Nos. 4,724,034 and 4,369,085. This rolling motion is impractical for use with mail labelers because the mail labels are too big and they are not in a roll. Consequently, a rolling motion would be very awkward for a mail labeler.

Present day labelers have additional drawbacks. Most of them are quite complex and have an array of printing devices and moving parts (i.e., springs, sprockets, adjustments and releases). With each of these moving parts, the likelihood of down-time due to broken parts increases. In addition, the likelihood of a paper jam increases with the complexity of the machine. Clearing a paper jam in a complex machine could be quite tiresome.

Further, clearing label jams in present day labelers is onerous because there is no clear, accessible label path. For example, in U.S. Pat. Nos. 4,382,835 and 4,369,085, the labels are buried deep within a machine and cannot be viewed without taking the machine apart. Because there is no clear label path, a user cannot detect many potential errors, such as duplicate labels or erroneous print before the label is applied. A clear label path would allow the user to sort and reject labels as they advance through the machine.

In addition, present day labelers fail to provide its user with a transparent wiper bar. See, for example, U.S. Pat. Nos. 4,853,068. Like a clear label path, a transparent wiper bar would permit the user to observe duplicate labels, erroneous labels, and to sort and reject labels before the labels are applied.

Accordingly, it is the primary object of the present invention to provide an improved hand-held labeling device, for mass mailings, which has relatively few moving parts and is easy to load and use.

It is another general object to provide such a labeling device with a clear and easy-to-see label path, so that its user can sort or reject self-adhesive labels during the application process.

It is a more specific object to provide an improved hand-held labeler with a transparent wiper and guide bar, so that labels may be viewed before application.

Still another object of the present invention is to provide a label applicator which does not require an application roller or a rolling motion to apply the self-adhesive labels to the surface to be labeled.

It is yet another object to provide a labeling device, commensurate with the above-listed objects, that allows labels to be applied in a gentle wiping action, rather than a convoluted rolling motion necessary with most applicators.

The above and other objects and advantages of this invention will become more readily apparent when the following description is read in conjunction with the accompanying drawings.

SUMMARY OF THE INVENTION

A simple label applicator is disclosed for applying self-adhesive labels to large numbers of mailing pieces, such as envelopes or packages. These self-adhesive labels are commonly referred to as "crack-and-peel" labels (i.e., self-adhesive labels attached to a waxed base ply, which together form a web). In the preferred embodiment, the invention comprises a hand-held applicator having an advance lever which turns two cooperating rolling bars; a transparent wiper bar with a corresponding deflection bar which guides a web of labels through the machine and which facilitates the application of the labels to an underlying piece; and a clear label path which allows a user to sort or reject labels during application and which facilitates clearing a paper jam.

To affix a label, a user simply squeezes the advance lever; this activates the driving mechanism which turns the forward roller and moves the label forward. As the label is moved forward, it is separated from the base ply. One stroke with a gentle wiping, not stamping, motion affixes the label to the mailing piece. After the advance lever springs back, the applicator is ready to apply the next label to the next mail piece.

DETAILED DESCRIPTION OF THE PREFERRED EMBODIMENT

Figure 1:
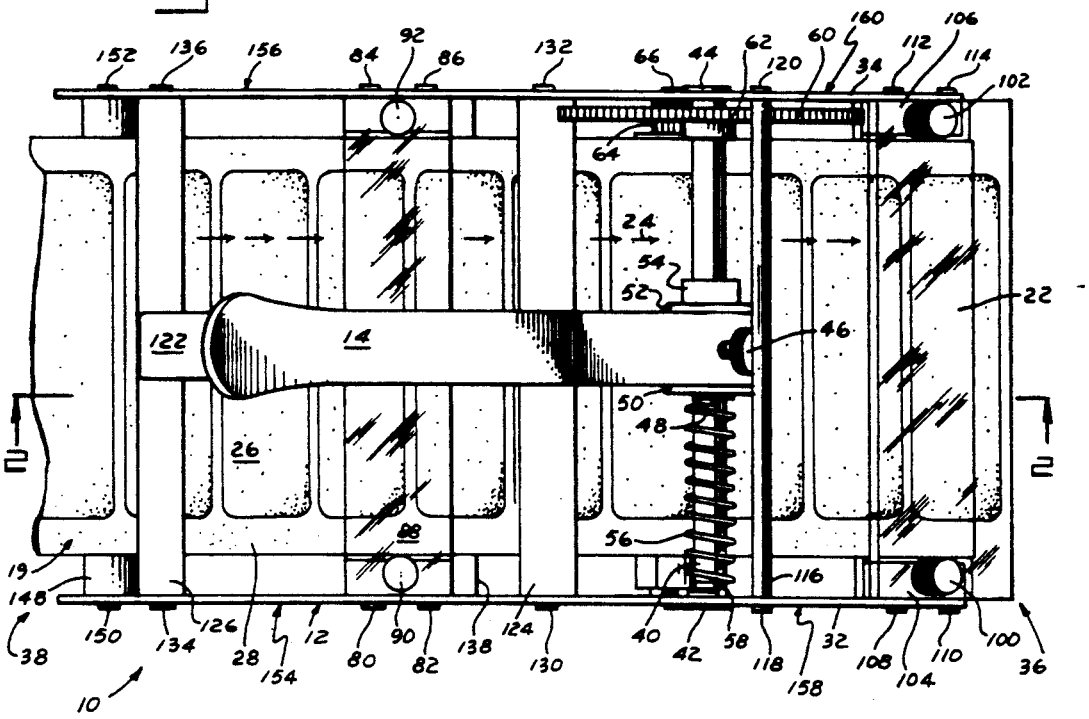
FIG. 1 is a top plan view of a hand-held label device constructed in accordance with the present invention.

Referring to the drawings in detail, the preferred embodiment of a hand-held labeler is shown and generally designated by the reference numeral 10. It is manufactured and marketed under the trademark The Wing SA-100 Mailer TM, by Chauncey Wing's Sons, Inc. of Greenfield, Massachusetts. The illustrated labeler 10 basically comprises an open housing 12; a movable advance lever 14 which turns two cooperating rolling bars 16, 18 (see FIGS. 2–4) which advance a web 19 of "crack-and-peel" labels through the housing; and a deflection bar 20 (see FIGS. 2–4) and a transparent wiper bar 22, which together form a stripping mechanism to separate and place the labels on underlying mailing pieces (not shown), like envelopes or packages. The arrangement of these parts results in a clear label path 24, shown by a set of phantom arrows. See FIG. 1.

The labeler 10 is designed for use with self-adhesive labels, generally known as "crack-and-peel" labels. Typically, crack-and-peel labels are comprised of a label, such as 26, and a base ply 28. Together, the label, such as 26, and the base ply 28 make up the web 19. See FIGS. 2, 4.

The housing 12 has two opposing sidewalls 32, 34; a front end 36; and a rear end 38. See FIG. 1. A transverse bar 40 extends between and is connected to each sidewall 32, 34 by any suitable means, such as ball bearings 42, 44. To accommodate the necessary rotational movement of the transverse bar 40 which has a squared cross-section, the ends of the transverse bar 40 are turned round and pressed into the ball bearings 42, 44. See FIG. 1. This connection allows the bar 40 to rotate, but it prohibits any axial movement of the bar 40.

The advance lever 14, which is adapted in size and shape to be easily grasped by its user (not shown), is between, and parallel to both sidewalls 32, 34 and is mounted perpendicularly to the transverse bar 40. See FIG. 1 The advance lever 14 can be attached to the transverse bar 40 at any point along its midlength. In the preferred embodiment, the advance lever 14 attaches to the center of the transverse bar 40. See FIG. 3.

Figure 3:
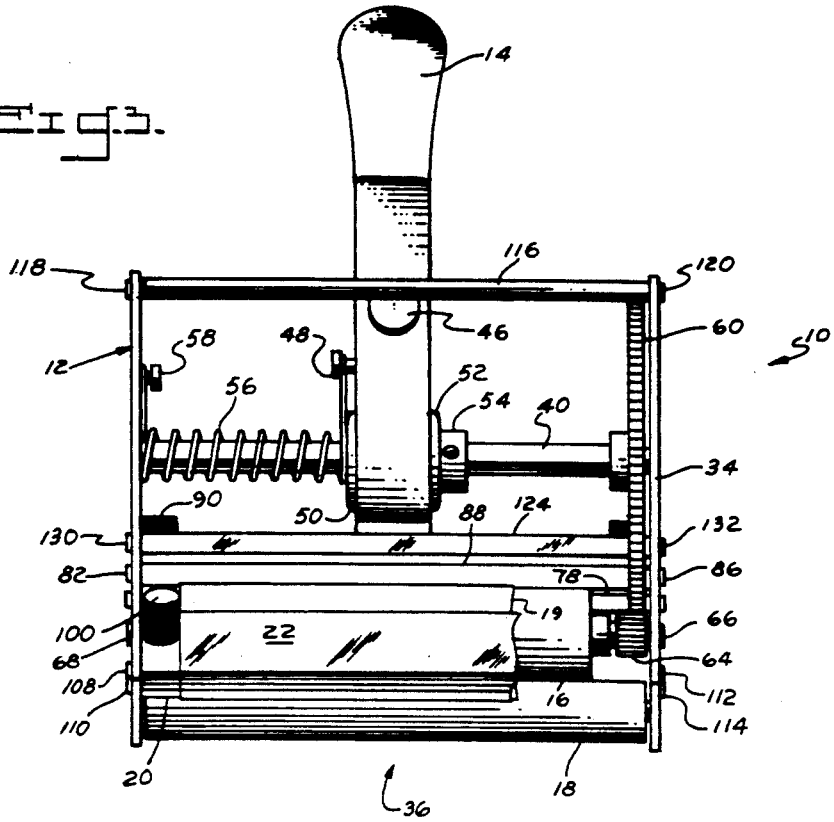
FIG. 3 is a front elevation view of the label machine with the webbing partially omitted for clarity.

Referring to FIGS. 1, 3 in the lower front portion of the advance lever 14, there is an adjustable screw 46. On the right-hand side of the advance lever 14 is a lever knob 48. (In FIG. 1, the upper portion is the left-hand side, while the lower portion is the right-hand side.) Below the lever knob 48 is a set screw collar 50. On the left-hand side of the lever 14 is another set screw collar 52, which is attached to rectangular mount 54. Both set screw collars 50, 52, fix the advance lever 14 to the transverse bar 40.

A torsion coil spring 56 wraps around the right-hand side of the transverse bar 40. See FIGS. 1, 3. The torsion coil spring 56 attaches to the advance lever 14 at the lever knob 48, wraps around the right-hand side of the transverse bar 40, and attaches to a sidewall knob 58. See FIGS. 1, 3.

On the left-hand side, the transverse bar 40 penetrates a drive gear 60, at the drive gear 60 center. See FIG. 3. The drive gear 60 is parallel to, and mounted near, the left-hand sidewall 34. The transverse bar 40 connects to the drive gear 60 by a rectangular mount 62. See FIG. 1. The drive gear 60 is positioned to, in turn, drive a smaller pinion gear 64. A shaft (not shown) on the pinion gear 64 is mounted to the left-hand sidewall 34 by any suitable means, such as a flanged ball bearing 66. See FIG. 3. As mentioned before, this ball bearing 66 allows for rotational movement, but prohibits axial movement, because it is pressed on a shoulder of the forward rolling bar 16.

The pinion gear 64 is fixed to a forward rolling bar 16. See FIGS. 3, 4. The forward rolling bar 16 has a rubber sleeve (not shown) and spans substantially between the two sidewalls 32, 34. Axial movement of the rubber sleeve along the forward rolling bar 16 is prevented by any suitable means, such as snap rings (not shown). The forward rolling bar 16 attaches to the right sidewall 32 by any suitable means, such as a flanged ball bearing 68, similar to the one described above.

The forward rolling bar 16 is positioned above and slightly ahead of a rearward rolling bar 18. See FIGS. 2, 4. The rearward rolling bar 18 contacts the forward rolling bar 16 at a series of points, such as 70. The rearward rolling bar 18 spans substantially the width of the machine, between sidewalls 32, 34. The rearward rolling bar 18 attaches to both sidewalls 32, 34 with any suitable mounts, such as ball bearings (not shown). Similar to the mounts mentioned before, the press fit of the bearings in the sidewalls 32, 34 and on the ends of the rearward rolling bar 18 allows rotational movement of the bar 18, but prohibits axial movement.

Behind the forward rolling bar 16 and in the center of the rolling bar 16 is an anti-jam bar 76. See FIG. 2. The anti-jam bar 76 is parallel to both sidewalls 32, 34 and extends back to, and attaches under, the base guide bar 78.

The base guide bar 78 stretches between the two sidewalls 32, 34 and is fixed to the sidewalls 32, 34 by two screws on each side 80, 82, 84, 86. See FIG. 1. Above and parallel to the base guide bar 78 is an upper, transparent guide bar 88. See FIGS. 1, 2. The upper, transparent guide bar 88 is attached to the base guide bar 78 by two thumbscrews 90, 92. Each thumbscrew 90, 92 passes through the transparent guide bar 88, then through a transparent spacer (not shown) and finally through the base guide bar 78. The transparent guide bar 88 is located sufficiently above the base guide bar 78 to allow the passage of labels such as 26 and corresponding base ply 28. The upper transparent guide bar 88 extends between the two sidewalls 32, 34, but it does not attach to the two sidewalls 32, 34.

Figure 2:
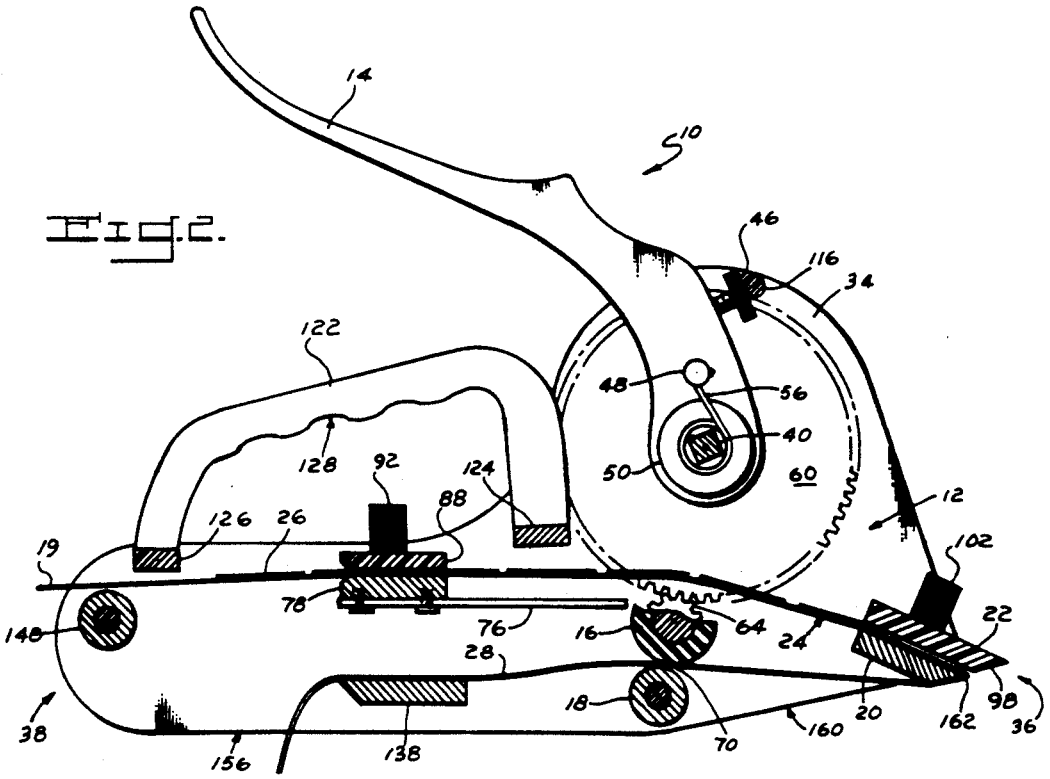
FIG. 2 is a side elevation in cross-section view of the labeler taken along lines 2—2 of FIG. 1.
Figure 4:
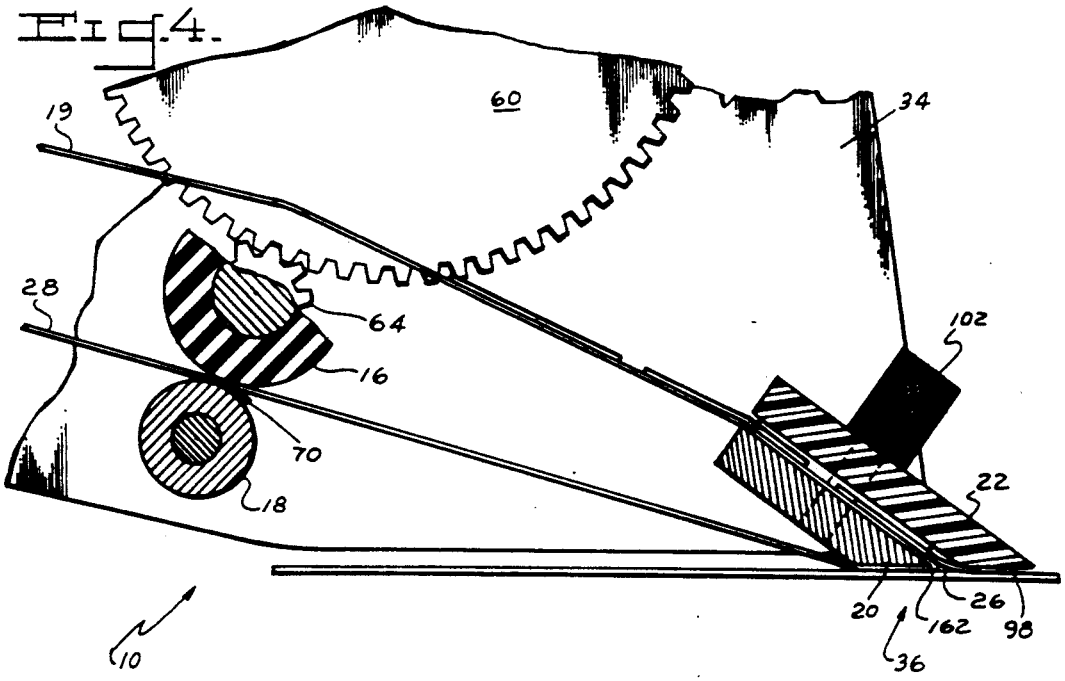
FIG. 4 is a side elevation, with portions broken away, showing the hand-held labeler operation: its advance lever is depressed by a user, a label is separated from its base ply, and the front of the machine is pressed adjacent to, and parallel with, the application surface.

In the front 36 of the labeler 10 are the two cooperating bars 20, 22, which together form a stripping mechanism. See FIGS. 2, 4. There is an upper, transparent wiper bar 22 which lies between the two sidewalls 32, 34 and cuts the two sidewalls 32, 34 at an angle. The transparent wiper bar 22 has a leading beveled edge 98. The deflection bar 20 has a leading beveled edge 99. The beveled edge 98 of the wiper bar 22 and the beveled edge 99 of the deflection bar 20 are aligned to strip the labels from the base ply, as shown in FIGS. 2, 4. These bars 20, 22 are located in the front of the housing 12 at substantially the end of the path for the labels, such as 26; however, the bars 20, 22 are located at substantially mid-path for the spent web 19. The wiper bar 22 is attached to the lower deflection bar 20 by two thumbscrews 100, 102, each of which passes through a transparent spacer 104, 106. See FIG. 1. Each spacer 104, 106 is fixed to the deflection bar 20. The two bars 20, 22 are sufficiently separated by spacers 104, 106 to allow the passage of labels such as 26 and base ply 28.

The housing 12, the transverse bar 40, the advance lever 14, the drive gear 60, the pinion gear 64, the forward rolling bar 16, the rearward rolling bar 18, the deflection bar 20, and the wiper bar 22 are arranged such that a user can substantially view the labels as they travel through the housing. The arrangement of these parts results in a clear label path 24.

The deflection bar 20 extends between the two sidewalls 32, 34 and is attached to each sidewall 32, 34 at an angle by four screws 108, 110, 112, 114. See FIG. 1.

The advance lever 14 rests against a positioning bar 116. See FIGS. 1, 3. The positioning bar 116 extends between the two sidewalls 32, 34 and is attached to the sidewalls 32, 34 by two screws 118, 120.

Below the advance lever 14 and in cooperation with the advance lever 14 is a handle 122. See FIGS. 1, 2. The handle 122 is parallel to the sidewalls 32, 34. The handle 122 is substantially a U-shaped bar which extends between a front handle bar 124 and a rear handle bar 126. The lower portion of the U-shaped handle 122 has a grooved surface 128, which is adapted in size and shape to accommodate a user's fingers. See FIG. 2. The front handle bar 124 extends between the two sidewalls 32, 34 and is mounted on each sidewall 32, 34 by any suitable means, such as screws 130, 132. See FIG. 1. Likewise, the rear handle bar 126 extends between the two sidewalls 32, 34 and is mounted to each sidewall by any suitable means such as screws 134, 136.

Below the base guide bar 78 rests a tear bar 138. The tear bar138 extends between the two sidewalls 32, 34. See FIG. 2. Each end of the tear bar 138 is attached to a sidewall 32, 34 by any suitable means, such as screws (not shown).

At the rear 38 of the labeler 10 is a round guide bar 148. See FIG. 1. The round guide bar 148 spans between the sidewalls 32, 34 and attaches to each sidewall 32, 34 by any suitable means, such as two screws 150, 152.

Each sidewall 32, 34 has a rear portion 154, 156 which rests against a flat surface when not in use. See FIGS. 1, 2. The front portion 158, 160 of each sidewall 32, 34 slopes upwardly and does not rest against a flat surface, when the labeler 10 is not in use. See FIG. 2.

In operation, the user must first feed the web 19, which is made up of labels such as 26 and base ply 28, through the labeler 10. See FIGS. 1, 2. To feed the web 19 through the machine 10, the web 19 is inserted above the round guide bar 148 and under the rear handle mount 126. The web 19 is then forwarded between the transparent guide bar 88 and the base guide bar 78, lining one end of the web 19 up with a straight edge of a spacer (not shown). The web 19 is continued forward over the anti-jam bar 76 and over the forward rolling bar 16. Then the web 19 is inserted between the transparent wiper bar 22 and the corresponding lower, deflection bar 20, lining the web 19 up with a straight edge of a transparent spacer such as 104 of the deflection bar 20. The web 19 is then evenly lined up between the rearward rolling bar 18 and the forward rolling bar 16. The user then depresses the advance lever 14 several times to secure the web 19 into its proper path. As the web 19 is advanced through the labeler 10, the user guides the web 19 over the tear bar 138. After the web 19 reaches the tear bar 138, it should be securely in place. Even if the web 19 is loaded at an angle, the rolling action of the machine 10 straightens the web 19. The web 19 is straightened after the user depresses the advance lever 14 several times.

After the labeler 10 has been properly loaded, the user is ready to use the labeling device 10. See FIGS. 1, 2. First, the user rests his palm on top of the advance lever 14 and wraps his fingers around the handle 122. As the advance lever 14 is depressed, it causes the transverse bar 40 to rotate. The transverse bar 40 imparts a force to the driving gear 60, which in turn rotates the pinion gear 64. The pinion gear 64 turns the forward rolling bar 16, which in turn rotates the rearward rolling bar 18. The web 19 is advanced by the cooperative turning of the forward and rearward rolling bars 16, 18.

As the web 19 is advanced, each label such as 26 is projected out and away from the base ply 28 by the sharp edge 162 of the deflection bar 20. See FIG. 4. This sharp edge 162 enhances the ability of the deflection bar 20 and wiper bar 22 to act as a striping mechanism.

To apply a label such as 26 to a labeling surface, such as a package, the user pushes the labeler 10 up onto its angled edges 158, 160. See FIGS. 1, 4. This permits the beveled edge 98 of the wiper bar 22 to be parallel with the label surface. When the user pushes the labeler 10 forward, the projected label such as 26 attaches to the labeling surface. After the label such as 26 is attached, the user slides, not rotates, the wiper bar 22 over the surface of the label 26, for instance, to ensure that the label such as 26 is fully adhered to the surface. In the alternative, however, the user could opt to move the package to adhere the label, rather than moving the machine 10.

After the label such as 26 is applied, the user allows the advance lever 14 to rise to its resting position, which is against the positioning bar 116. The coil spring 56 returns the advance lever 14 to its resting position. The advance lever 14 returns to its original position without rotating the transverse bar 40. See FIG. 1. The advance lever 14 returns to its original position by a standard one-way clutch. The preferred embodiment incorporates a clutch manufactured by Torrington Company, located in Farmington, Connecticut, Model No. RC—081208.

After several labels such as 26 have been applied, the user can remove excess base ply 28 by ripping it off against the tear bar 138. See FIG. 4.

The anti-jam bar 76 prevents the excess base ply 28 from rising up and interfering with the path of the web 19 in use.

Due to the paucity and the arrangement of the parts, and the transparency of the wiper bar 22 and the guide bar 88, there exists a clear label path 24. See FIG. 1. Thus, the user is able to see the labels at all times. This allows the user to spot potential label jams before they are dehabilitating. In addition, the user can spy duplicate or erroneous labels before these labels are attached.

The lever screw 46 in the top of the advance lever 14 can be adjusted to accommodate labels of various widths.

Because the label supply does not have to fit within the machine 10, the user does not have to worry about the weight of the web 19 disrupting the user's balance.

The base guide bar spacers (not shown) and the deflection bar spacers 104, 106 serve two purposes. First, they ensure a particular height between the corresponding bars 20, 22 and 78, 88, so that the webbing 19 can pass through easily. Second, the spacers can be made wider or narrower to accommodate labels of various widths. For instance, if a user were to use very narrow labels, then the spacers would be made very wide, and vice-versa. This would decrease the amount of play in the machine 10; consequently, it would reduce the likelihood of a jam.

It should be understood by those skilled in the art that obvious structural modifications can be made without departing from the spirit of the invention. For example, the label applicator 10 could be automated; thus, it would not be limited to a hand-held device. Further, the inventor anticipates that the gearing can be modified to accommodate labels of various lengths. Accordingly, reference should be made primarily to the accompanying claims rather than the foregoing specification to determine the scope of the invention.

Having thus described the invention, what is claimed is:

1. A hand-held labeling device comprising:
a. a housing having opposed sidewalls;
b. a transverse bar rotatably mounted between the sidewalls;
c. an advance lever means fixedly mounted to the transverse bar, along with the bar's midlength, whereby the advance lever activates the transverse bar and causes it to rotate when the advance lever is depressed, and wherein the advance lever is adapted in size and shape to accommodate a user's hand;
d. a drive gear having a first and second side, wherein the gear's first side is drivingly connected to the transverse bar and is rotated by the transverse bar when the advance lever is depressed;
e. a pinion gear that meshes with the drive gear and is attached to a rolling bar, whereby the drive gear rotates this pinion gear when the advance lever is depressed;
f. a forward rolling bar fixed between the pinion gear and a sidewall, wherein the forward rolling bar is rotated simultaneously with the pinion gear;
g. a rearward rolling bar rotatably mounted between the sidewalls, wherein the rearward bar is adjacent to the forward rolling bar, wherein the rolling motion of the forward bar causes rearward bar to turn;
h. a beveled deflection bar fixed between the sidewalls at a front portion of the machine for separating labels from a base ply, wherein a label web consists of self-adhesive labels adhered to a base ply of laminated paper;
i. a beveled wiper bar mounted above and parallel to the deflection bar and extending between the sidewalls, wherein a leading beveled edge of the wiper bar works in cooperation with an underlying aligned leading beveled edge of the deflection bar to strip the labels from the base ply; and
j. a means for enabling a user to substantially view the labels as they travel through the housing.

2. The hand-held labeling device of claim 1, wherein the wiper bar is composed of a transparent plastic.

3. The hand-held labeling device of claim 1, wherein an upper guide bar is mounted in the rear of the invention, between both sidewalls, and aids in maneuvering the labels through said deflection bar and wiper bar.

4. The upper guide bar of claim 3, wherein the upper guide bar is transparent such that the labels may be seen during the labeling process.

5. The hand-held labeling device of claim 1, wherein a base guide bar is mounted between the sidewalls, wherein the base guide bar is parallel to and below the upper guide bar, wherein the base guide bar is mounted to the upper guide bar by two thumbscrews, and wherein both the upper and base guide bars are mounted to leave a slot large enough for entry and exit of a web of labels.

6. The base guide bar of claim 5, wherein at least two rectangular spacers are inserted between the upper and base guide bars to ensure adequate space for the labels and to decrease the amount of play in the machine.

7. The hand-held labeling device of claim 1, wherein an anti-jam bar is mounted to the base guide bar and extends from the base guide bar to the forward rolling bar and is parallel to the sidewalls, wherein the anti-jam bar prevents excess base ply from rising up and interfering with the path of a web.

8. The hand-held labeling device of claim 1, wherein a tear bar is mounted between side sidewalls and under the base guide bar, wherein the user can remove excess base ply by ripping it off against the tear bar.

9. The hand-held labeling device of claim 1, wherein a round guide bar is mounted between both sidewalls near the end of the machine to facilitate the movement of the labels through the machine.

10. The hand-held labeling device of claim 1, wherein a U-shaped handle is fixed between a front mount and a rear mount, wherein the opposing mounts are perpendicular to the sidewalls, and wherein the handle is parallel, and between the sidewalls.

11. The U-shaped handle of claim 10, wherein the underneath side has a grooved underside, adapted in size and shape to accommodate a user's fingers.

12. The hand-held labeling device of claim 1, wherein the sidewalls have upwardly sloping front portions.

13. The hand-held labeling device of claim 1, wherein the transverse bar has a coil spring, which is interconnected to the lever, and wraps around the transverse bar and interconnects to a sidewall, whereby the coil causes the lever to snap back to its original position after it is depressed.

14. The hand-held labeling device of claim 1, wherein the advance lever rests against a positioning bar when not in use by an adjustable screw in its front portion, wherein the adjustable screw can be adjusted to accommodate labels of various sizes.

15. The hand-held labeling device of claim 1, wherein the deflection bar has attached polygonal spacers which can be varied in size to accommodate various sizes of labels to decrease the amount of play in the machine.

16. The hand-held labeling device of claim 1, wherein the deflection bar and wiper bar are mounted together by at least one thumbscrew.

17. In a labeling machine of the type having a horizontal path for a web of self-adhesive labels, wherein the improvement comprises a striping mechanism of the type having an upper wiper bar, and a cooperating deflection bar which separates a self-adhesive label from a base ply of the web and which allows the user to apply the label with a wiping motion; the upper wiper bar comprises a leading beveled edge which works in cooperation with an underlying leading beveled edge of the deflection bar to strip the labels from the base ply; and a means for enabling a user to substantially view the labels as they move through the labeling machine.

18. The wiper bar of claim 17, wherein the wiper bar is made of transparent plastic.

19. A driving mechanism for moving a web of self-adhesive labels through a labeling machine, wherein the improvement comprises a U-shaped label path for the web which runs through cooperating deflection plate and a wiper plate which together form a striping mechanism; cooperating rolling bars which pull a base ply away from the self-adhesive labels; a drive mechanism for driving the cooperating rolling bar; the upper wiper bar comprises a leading beveled edge which works in cooperation with an underlying leading beveled edge of the deflection bar to strip the labels from the web; and a means for enabling a user to substantially view the labels as they travel through the labeling machine.

20. A hand-held labeling device comprising:
a. a housing having opposed sidewalls;
b. a transverse bar rotatably mounted between the sidewalls;

c. an advance lever means fixedly mounted to the transverse bar, along the bar's midlength, whereby the advance lever activates the transverse bar and causes it to rotate when the advance lever is depressed, and wherein the advance lever is adapted in size and shape to accommodate a user's hand;

d. a drive gear having a first and second side, wherein the gear's first side is drivingly connected to the transverse bar and is rotated by the transverse bar when the advance lever is depressed;

e. a pinion gear that meshes with the drive gear and is attached to a rolling bar, whereby the drive gear rotates this pinion gear when the advance lever is depressed;

f. a forward rolling bar fixed between the pinion gear and a sidewall, wherein the forward rolling bar is rotated simultaneously with the pinion gear;

g. a rearward rolling bar rotatably mounted between the sidewalls, wherein the rearward bar is adjacent to the forward rolling bar, wherein the rolling motion of the forward bar causes rearward bar to turn;

h. beveled deflection bar fixed between the sidewalls at a front portion of the machine for separating labels from base ply, wherein a label web consists of self-adhesive labels adhered to a base ply of laminated paper;

i. beveled wiper bar mounted above and parallel to the deflection bar and extending between the sidewalls, wherein a leading beveled edge of the wiper bar works in cooperation with an underlying aligned leading beveled edge of the deflection bar to strip the labels from the base ply and wherein the wiper bar is comprised of transparent plastic, so as to enable a user to view labels as they are stripped from the base ply;

j. an upper guide bar, wherein the upper guide bar is mounted in the rear of the housing, between both sidewalls, and aids in maneuvering the labels through said deflection bar and wiper bar; and k. a base guide bar, wherein the base guide bar is mounted between the sidewalls and is parallel to and below the upper guide bar, wherein the base guide bar is mounted to the upper guide bar by two thumbscrews, and wherein both the upper and base guide bars are mounted to leave a slot large enough for entry and exit of a web of labels.

21. The upper guide bar of claim 20, wherein the upper guide bar is comprised of transparent plastic such that the labels may be seen during the application process.

22. The base guide bar of claim 20, wherein at least two rectangular spacers are inserted between the upper and base guide bars to ensure adequate space for the labels and to decrease the amount of play in the machine.

23. The hand-held labeling device of claim 20, wherein an anti-jam bar is mounted to the base guide bar and extends from the base guide bar to the forward rolling bar and is parallel to the sidewalls, wherein the anti-jam bar prevents excess base ply from rising up and interfering with the path of a web.

24. The hand-held labeling device of claim 20, wherein a tear bar is mounted between side sidewalls, wherein the user can remove excess base ply by ripping it off against the tear bar.

25. The hand-held labeling device of claim 20, wherein a round guide bar is mounted between both sidewalls near the end of the machine to facilitate the movement of the labels through the machine.

26. The hand-held labeling device of claim 20, wherein a U-shaped handle is fixed between a front mount and a rear mount, wherein the opposing mounts are perpendicular to the sidewalls, and wherein the handle is parallel to and between the sidewalls.

27. The U-shaped handle of claim 26, wherein the handle has a grooved underside, adapted in size and shape to accommodate a user's fingers.

28. The hand-held labeling device of claim 20, wherein the sidewalls have upwardly sloping front portions.

29. The hand-held labeling device of claim 20, wherein the transverse bar has a coil spring, which is interconnected to the lever, and wraps around the transverse bar and interconnects to a sidewall, whereby the coil causes the lever to snap back to its original position after it is depressed.

30. The hand-held labeling device of claim 20, wherein the advance lever rests against a positioning bar when not in use.

31. the hand-held labeling device of claim 20, wherein the deflection bar has attached polygonal spacers which can be varied in size to accommodate various sizes of labels to decrease the amount of play in the machine.

32. The hand-held labeling device of claim 20, wherein the deflection bar and wiper bar are mounted together by at least one thumbscrew.

* * * * *